US012139860B2

(12) United States Patent
Schneider

(10) Patent No.: US 12,139,860 B2
(45) Date of Patent: Nov. 12, 2024

(54) PAVER WITH RELEASABLE CONTROL PANEL HAVING AN EMERGENCY STOP SWITCH

(71) Applicant: VOLVO CONSTRUCTION EQUIPMENT AB, Eskilstuna (SE)

(72) Inventor: Kristof Schneider, Hameln (DE)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 609 days.

(21) Appl. No.: 17/432,324

(22) PCT Filed: Feb. 20, 2019

(86) PCT No.: PCT/EP2019/054224
§ 371 (c)(1),
(2) Date: Aug. 19, 2021

(87) PCT Pub. No.: WO2020/169193
PCT Pub. Date: Aug. 27, 2020

(65) Prior Publication Data
US 2022/0298731 A1 Sep. 22, 2022

(51) Int. Cl.
*E01C 19/48* (2006.01)

(52) U.S. Cl.
CPC ..... *E01C 19/48* (2013.01); *E01C 2301/10* (2013.01)

(58) Field of Classification Search
CPC ..... E01C 19/48; E01C 2301/10
(Continued)

(56) References Cited

U.S. PATENT DOCUMENTS 5,356,238 A * 10/1994 Musil ..... E01C 19/008 404/101
5,462,122 A * 10/1995 Yamamoto ..... E02F 3/842 701/50

(Continued)

FOREIGN PATENT DOCUMENTS

CN 1838002 A 9/2006
CN 101074551 A 11/2007

(Continued)

OTHER PUBLICATIONS

International Search Report and Written Opinion dated Jan. 15, 2020 in corresponding International PCT Application No. PCT/EP2019/054224, 17 pages.

(Continued)

*Primary Examiner* — Raymond W Addie
(74) *Attorney, Agent, or Firm* — Venable LLP; Jeffri A. Kaminski

(57) ABSTRACT

A road building machine for laying asphalt with a control switch (40) which is interconnected in an emergency stop circuitry (100), wherein said control switch is arranged at the paver outside from a detachable second control panel (120), wherein said control switch (40) is connected in a functional parallel electrical arrangement with a second electric emergency stop switch (20) if the detachable second control panel (120) is electrically connected to an electronic control circuit, wherein said control switch (40) is actuated by a switch function activated by said electrical coupling of said detachable second control panel (120) to said electronic control circuit such that if said detachable second control panel (120) is electrically connected to said electronic control circuit, said control switch (40) is actuated to be open, such that the emergency stop circuitry (100) is closed
(Continued)

or open via said first or said second electric emergency stop switch (10, 20).

13 Claims, 4 Drawing Sheets

(58) Field of Classification Search
USPC ..... 404/84.05–84.5, 118
See application file for complete search history.

(56) References Cited

U.S. PATENT DOCUMENTS

| | | | | |
|---|---|---|---|---|
| 5,908,459 | A | 6/1999 | Rower et al. | |
| 9,963,836 | B1 * | 5/2018 | Brenner | G01B 17/06 |
| 10,053,822 | B2 * | 8/2018 | Eul | H04L 12/40 |
| 2018/0354351 | A1 * | 12/2018 | Buschmann | B60J 7/165 |
| 2023/0278834 | A1 * | 9/2023 | Appling, Jr. | H04L 67/12 701/2 |

FOREIGN PATENT DOCUMENTS

| | | | | |
|---|---|---|---|---|
| CN | 202247623 | U | 5/2012 | |
| CN | 109066243 | A | 12/2018 | |
| DE | 102019002440 | A1 * | 10/2020 | B60W 50/00 |
| EP | 1353418 | A2 | 10/2003 | |
| EP | 2644454 | A1 | 10/2013 | |
| JP | H06149349 | A | 5/1994 | |

OTHER PUBLICATIONS

Chinese Office Action dated Apr. 8, 2022 in corresponding Chinese Patent Application No. 201980092786.5, 10 pages.

* cited by examiner

PAVER WITH RELEASABLE CONTROL PANEL HAVING AN EMERGENCY STOP SWITCH

CROSS-REFERENCE TO RELATED APPLICATIONS

This application is a U.S. National Stage application of PCT/EP2019/054224, filed Feb. 20, 2019, and published on Aug. 27, 2020, as WO 2020/169193 A1, all of which is hereby incorporated by reference in its entirety.

TECHNICAL FIELD

The invention relates to road building machines like pavers for laying asphalt and, more specifically, to such road building machines having a detachable control panel.

The invention is e.g. applicable on road building machines within the field of industrial construction machines or construction equipment, in particular pavers. Although the invention will be described with respect to a paver, the invention is not restricted to this particular machine, but may also be used in other road building machines having at least one detachable control panel with an emergency stop switch, such as e.g. asphalt milling machines.

BACKGROUND

Pavers are industrial construction machines that are used to lay a road surface, usually made from asphalt or concrete. Such pavers usually comprise a first control panel and one or more detachable control panels, which are typically located at the sides of the screed of the paver. The detachable control panel(s) provide(s) an overview of different settings to the operators positioned at the sides of the screed and allow these operators to control several functions and settings of the components of the paver to control the paving process. To meet safety requirements, these control panels are usually equipped with an emergency stop switch. An emergency stop switch is understood to be an electrical switch component providing a user interface for manual operation. In regular operation the emergency stop switch is in a first position, e.g. in a closed circuit condition. The emergency stop switch can be actuated or activated by a user, e.g. by pushing a button of the switch, and hereby the emergency stop switch is transferred into a second position, e.g. an open circuit condition. In this second condition, all or relevant operations of the working machine are set to safe state, e.g. are stopped and maintained in a non-moving condition or any actuators are retracted to a safe position or set in a floating condition. Furthermore, the engine of the paver is stopped. Generally, it is understood that the safe state established in the second condition where an emergency stop switch is activated may comprise different action and stop of action at the actuators of the machine, depending from the risk of injury produced by such actuator.

Generally, such emergency stop switches are required to prevent accidents and industrial injuries which might occur if an operator is captured by a moving component of the working machine or in other hazardous situations. To fulfil its purpose, an emergency stop switch must be positioned within immediate reach of an operator. Usually at larger working machines multiple emergency stop switches are provided to enhance safety and thus an emergency stop switch is usually provided at a detachable control panel as well. Usually, to meet safety requirements, all control panels have to be equipped with an emergency stop switch. On a regular basis, e.g. after a construction process, these control panels are demounted when they are not needed for a specific period of time. Such detachable control panels are known for example from U.S. Pat. No. 5,908,459 A.

A fundamental problem of existing road building machines like pavers with detachable control panels is that due to the demounting of a control panel, the emergency stop circuitry is open which limits the function of the paver and the paver cannot be moved in this condition.

Usually, to overcome this problem and to be able to use and move the paver in the case of a demounted auxiliary control panel, a dummy plug is mounted at the interface where the control panel was electrically connected to close the open emergency stop circuitry along the open section at this location. However, a disadvantage of this solution is that this procedure is cumbersome and if the dummy plug is not available when needed, the road building machine cannot be used which can lead to downtime and hence to high costs.

SUMMARY

An object of the invention is to provide a road building machine with a main emergency stop and detachable control panel including a second emergency stop, wherein functionality of the emergency stops is safely guaranteed in a reliable way.

The object is achieved by a road building machine for laying asphalt according to claim 1. This road building machine comprises an electronic control circuit for controlling at least one actuator for driving said road building machine and/or handling a building material within said road building machine. Said electronic control circuit comprises an emergency stop circuitry adapted to provide electrical energy for controlling at least one of said actuators, preferably to all actuators. Said emergency stop circuitry is adapted to supply electrical energy for controlling said at least one or all actuators in a closed circuit condition for driving said actuator(s) and to interrupt said supply of electrical energy to effect a shutoff of at least one of said actuators of the road building machine in an open circuit condition.

Further the road building machine comprises a first control panel mounted to the road building machine which comprises a plurality of electronic control switches electrically connected to said electronic control circuit. Said first control panel further comprises a first electric emergency stop switch interconnected in the emergency stop circuitry, wherein in a first switching condition the first electric emergency stop switch closes the emergency stop circuitry and in a second switching condition the first electric emergency stop switch opens the emergency stop circuitry.

Further the road building machine comprises a detachable second control panel. The second control panel may be detachably mounted to the road building machine and detachably coupled for electric signal transmission to the electronic control circuit by a wired connection or may be a handheld device being connected to the electronic control circuit wirelessly. Said detachable second control panel comprises a second electric emergency stop switch arranged at the detachable second control panel and interconnected in the emergency stop circuitry if the detachable second control panel is electrically connected to the electronic control circuit. Coupling of the second emergency stop switch to the emergency stop circuitry may be integral with or separate from the coupling to the electronic control circuit and may further be either by wire connection or by wireless connection.

Said detachable second control panel may comprise a plurality of second electronic control switches electrically connected to said electronic control circuit.

In a first switching condition the second electric emergency stop switch closes the emergency stop circuitry and in a second switching condition the second electric emergency stop switch opens the emergency stop circuitry.

The road building machine comprises at least one actuator. This is understood to be e.g. a combustion engine for moving said road building machine via a transmission gear and/or for driving at least one hydraulic pump which provides hydraulic fluid to at least one hydraulic actuator of the road building machine. The road building machine usually comprises a plurality of actuators like the combustion engine, a plurality of hydraulic motors, hydraulic pistons, electric motors. All actuators may be shutoff immediately following actuation of an emergency stop switch at the road building machine. In some embodiments, only particular actuators may be shutoff in case of an emergency stop—e.g. only those actuators directly effecting a moving of parts of the road building machine. All or some actuators, in particular hydraulically driven actuators may be controlled by electrically controlled valves and the opening of the emergency stop circuit may effect a shutoff of such valves to set the hydraulic actuators controlled by the valve to a safe state.

Generally, the first and the second control panel may both be detachable control panels. However, in many preferred configurations, the first control panel may be a main control panel mounted non-detachable in a main operating stand whilst the second control panel is a detachable auxiliary control panel at a rear position of the road building machine. The road building machine may be equipped with further detachable control panels.

Said first electric emergency stop switch and said second electric emergency stop switch are functionally connected to said emergency stop circuitry to effect said opening of said emergency stop circuitry with a logical 'OR' function such that said emergency stop circuitry is open if any or both of the first electric emergency stop switch and the second electric emergency stop switch is in the second switching condition. The detachable second control panel is adapted to be either mounted to the road building machine and electrically connected to said electronic control circuit including said emergency stop circuitry or to be demounted from the road building machine with said detachable second control panel being electrically disconnected from said electronic control circuit and said emergency stop circuitry. It may be a handheld device, wherein it is understood, that demounting, detaching and disconnecting is corresponding to a wireless signal connection being disconnected.

The road building machine is characterized in that said emergency stop circuitry comprises a control switch which is interconnected in the emergency stop circuitry, wherein said control switch is arranged at the road building machine outside from said detachable control panel. The arrangement of the control switch at the road building machine outside from the detachable second control panel means that the control switch is not part of said detachable control panel. Said control switch is connected in a functional parallel electrical arrangement with the second electric emergency stop switch if the detachable second control panel is electrically connected to the electronic control circuit. Said control switch may be actuated manually. Further, said control switch may preferably be actuated by a switch function activated by said electrical coupling of said detachable second control panel to said electronic control circuit such that if said detachable second control panel is electrically connected to said electronic control circuit. Said control switch is actuated to be in the open condition, such that the emergency stop circuitry is closed or opened via said first or said second electric emergency stop switch if said detachable second control panel is electrically connected to the control circuit. If said detachable second control panel is electrically disconnected from said electronic control circuit, said control switch is actuated to be in the closed condition, such that the emergency stop circuitry is closed or opened via said first electric emergency stop switch. Generally, in a first condition said control switch is open and in a second condition said control switch is closed. It is generally understood that beside said first and second emergency stop switch further emergency stop switches may be interconnected in said emergency stop circuitry. The invention provides for a proper compensation if the second emergency stop switch is disconnected from the emergency stop circuitry. The principle of the invention may be applied to other emergency stop switches in the circuit, correspondingly, by providing a corresponding control switch in parallel arrangement to such other emergency stop switch.

The electronic control circuit is configured to control a single or different actuators, wherein a first actuator may control the driving of the road building machine or drive the road building machine and a second actuator may conduct a handling of the building material, which can be asphalt, concrete, another material or a composite material comprising different materials. Such handling of the building material may e.g. comprise conveying, distributing, heating or compacting of the building material.

The emergency stop circuitry is configured to provide electrical energy for controlling at least one actuator, preferably at least the first actuator and the second actuator. An interruption of the emergency stop circuitry at any location leads to an open circuit condition and to a stop of energy supply. This results in at least one of the actuators being set to a safe state e.g. by an immediate stop of at least one of the actuators preferably in such a way that the applicable safety requirements for an emergency stop are met. A safe state like a shutoff of an actuator may be understood as an immediate stop in a meaning that the actuator neither directly conducts a movement nor may be moved indirectly by external force. A shutoff may be a floating condition of the actuator wherein the actuator is no longer driven and thus stops as well but wherein the actuator may be moved indirectly by external force. Both alternatives of a shutoff condition meet the safety requirements for an emergency stop for specific type of actuators.

Generally, the emergency stop circuitry may directly provide electrical energy for driving an electrically driven actuator or may indirectly provide electrical energy to such an electrically driven actuator via controlling a relay switch or may provide an electronic signal for an electronic control unit or electronic logic, which controls an electrically driven actuator. For such electrically driven actuators, thus, the opening of the emergency stop circuitry may effect an immediate stop due to interruption of energy supply. Actuators of the working machine which are driven by other types of energy, e.g. hydraulic actuators or a combustion engine, are stopped via said opening of the emergency stop circuit in an indirect control method. E.g. an electro-magnetic valve controlling such hydraulic actuator may be electrically connected to said emergency stop circuit and hereby switched into a valve position effecting a stop or a free-floating condition of said hydraulic actuator. A combustion engine may include a control device electrically connected to said emergency stop circuitry and effecting an immediate stop of the combustion engine in case of the emergency stop circuitry being opened. This may be accomplished e.g. by stop of fuel injection, exhaust blockage, a mechanical brake in the drivetrain or the like.

The first control panel and the detachable second control panel are each preferably configured to provide control of several functions of the road building machine. Mounting the detachable second control panel to the road building machine preferably leads to an electrical connection of the detachable second control panel to the electronic control circuit wherein the mechanical fixation of the detachable second control panel to the road building machine and the electrical connection of the detachable second control panel to the road building machines control circuit may be accomplished as an integral step by an integral mechanical/electrical coupling interface or may be accomplished by separate couplings and coupling steps. Furthermore, demounting the detachable second control panel from the road building machine preferably leads to an electrical disconnection from the detachable second control panel to the electronic control circuit by either an integral step or two separate decoupling steps.

Hereby an improvement is that the road building machine described herein solves the problem of the need of a dummy plug or another manually inserted bypass to be mounted at the interface where a detachable second control panel was mounted to close the open emergency stop circuitry along the open section at this location. Therefore, with the described road building machine no downtime due to non-availability of a dummy plug is possible. Another advantage of the present invention is that preferably mounting the detachable second control panel automatically activates the second electric emergency stop switch and preferably demounting automatically deactivates the second electric emergency stop switch and at the same time closes the emergency stop circuitry outside from the detachable second control panel. Hence, no manual action is needed regarding the emergency stop circuitry when mounting or demounting the detachable control panel.

According to one embodiment, the road building machine is characterized in that if the detachable second control panel is electrically connected to said electronic control circuit, the control switch and the second electric emergency stop switch are functionally connected to the emergency stop circuitry to effect said opening of said emergency stop circuitry with a logical 'AND' function, such that said emergency stop circuitry is open if both of said control switch and the second electric emergency stop switch are in the second, open condition.

The control switch and the second electric emergency stop switch are preferably connected in parallel to achieve such a logical 'AND' function. An advantage is that in the case of the detachable second control panel being electrically connected to the electronic control circuit, the emergency stop circuitry can be closed (i.e. closed circuit condition) and opened (i.e. interrupted circuit condition) by the second electric emergency stop switch because the control switch is open in this condition.

It is particularly preferred that the emergency stop circuitry provides an emergency stop signal to an emergency stop control unit adapted to effect said emergency shutoff depending on said emergency signal, wherein said emergency signal preferably is a binary ON/OFF-signal depending from the emergency stop circuitry being open or close. According to this embodiment, the emergency stop circuitry does not provide a direct electrical energy supply to the actuators of the machine but rather provides a signal which is monitored by an emergency stop control unit, wherein said emergency stop control unit is adapted to effect an emergency shutoff depending on said emergency stop signal. This may allow e.g. to maintain energy supply to control units of the machine and to thus avoid a shutoff of the control circuit and control units in case of an emergency situation such that time to run up the machine after an emergency stop is shortended.

According to a further embodiment, the road building machine is characterized in that if the emergency stop circuitry is opened, the electric control circuit is interrupted, preferably by interrupting an ignition plus terminal, and an engine of the road building machine is stopped.

Generally, the emergency stop circuitry may effect a disconnecting of the ignition plus terminal from the battery by direct interruption in the open condition, i.e. the ignition plus terminal is directly connected to the battery via the emergency stop circuitry and this connection is then interrupted in the open condition of the emergency stop circuitry to effect disconnection, or indirectly, e.g. via relays. By this, all electronic control unit outputs are switched off and thus all functions are stopped. As a further, separate measure, the emergency stop circuitry may effect stopping of the combustion engine via separate control means in the open condition.

Alternatively, opening of the emergency stop circuitry may control an input of an electronic control unit of the road building machine to effect shutoff of an actuator controlled by said electronic control unit.

It is preferred that the second control panel is mechanically detachably mounted to the paver and electrically detachably coupled for electric signal transmission to the electronic control circuit, or a remote control panel detachably coupled for electric signal transmission to the electronic control circuit including said emergency stop circuitry via wireless signal transmission. This will allow to use the second control panel at a particular position at the machine or remote from the machine, e.g. as a safety device used by a supervisor at an elevated position in a distance from the machine.

According to a further embodiment, the road building machine is characterized in that if the detachable second control panel is electrically connected to said electronic control circuit, the control switch is adapted to automatically switch into the first, open condition, and if the detachable second control panel is electrically disconnected from said electronic control circuit, the control switch is adapted to automatically switch into the second condition to close said emergency stop circuitry.

Hereby an advantage is that in the case of the detachable second control panel being electrically disconnected from the electronic control circuit, an automatic closing of the emergency stop circuitry by closing the control switch allows for further using all functions of the road building machine without the need of manually installing a bypass.

According to a further embodiment, the road building machine is characterized in that if the detachable second control panel is electrically connected to said electronic control circuit, a relay supply circuit is closed to supply a relay with electric current, wherein said relay incorporates the control switch to automatically switch in the first condition, and if the detachable second control panel is electrically disconnected from said electronic control circuit, the relay supply circuit is open so that said relay is not supplied with electric current and the control switch incorporated in said relay is adapted to automatically switch in the second condition. Generally, the control switch may thus be embodied as a normally closed contact (NCC) within said relay.

A relay comprises a load switch connected to load terminals of the relays and an electro-magnetic actuator, like a magnetic coil, operating said load switch and being connected to control terminals of the relays. Thus, a relay forms an integrally actuated switch. The load switch of such relay may form the control switch according to the invention.

Preferably, the control terminals are connected to a relay supply circuit which is connected to the detachable second control panel in such a way that the control terminals of the relay are only supplied with electric energy if the detachable second control panel is coupled to the electronic control circuit and/or mounted to the road building machine. Hereby an improvement is that this allows for a safe and reliable automatic control of the relay incorporating the control switch which is operated by the electromagnetic actuator of the relay. No manual action is needed for this control.

According to a further embodiment, the road building machine is characterized in that if the detachable second control panel is electrically connected to said electronic control circuit, said relay incorporating said control switch is actuated to automatically switch in the first condition corresponding to an open condition, and if the detachable second control panel is electrically disconnected from said electronic control circuit, the control terminals of said relay are not supplied with electric current thus effecting the control switch to be actuated into a closed condition.

An advantage of this embodiment is that the control switch incorporated in the relay is switched in the second condition (closed) condition if the second emergency stop switch is electrically disconnected from said emergency stop circuit—e.g. due to the detachable second control panel being electrically disconnected from the control circuit of the road building machine and therefore the emergency stop circuitry is closed by the control switch and thus is set in a functional state for use with other emergency stop switches in the emergency stop circuitry.

According to a further embodiment, the road building machine is characterized in that mounting the detachable second control panel to the road building machine and/or electrically coupling said detachable second control panel to the electronic control circuit actuates both the control switch to switch in the first condition, and an energy supply switch to activate an electrical energy supply for the detachable control panel.

This means that preferably the control of both the control switch and the energy supply switch supplying the detachable second control panel with energy is coupled. This is an important safety feature since a user can recognize a correctly or incorrectly connected detachable second control panel due to the presence or absence of power supply of the detachable control panel. An advantage is that the user can rely on the second electric emergency stop switch in case of presence of power supply of the detachable control panel. The energy supply switch may be embodied as a normally open contact (NOC) within said relay. Thus the relay may be embodied as a double switch relay having an NCC and an NOC. Alternatively, the relays may have two changeover contacts connected to the control switch and the energy supply switch to fulfill the functions of an NCC and an NOC, respectively.

According to a further embodiment, the road building machine is characterized in that the electronic control circuit is provided with electrical energy in an open circuit condition of the emergency stop circuitry. This allows for the control system or parts of the control system with the electronic control circuit to further function in case of an emergency stop event, even if the main functions of the road building machine such as driving and others are not working due to an interrupted emergency stop circuitry. This might be advantageous since resetting the system and start working after an emergency stop can be executed faster than in the case of a power fail restart where the whole system has to reboot.

According to a further embodiment, the road building machine is characterized in that the control switch and the energy supply switch are actuated synchronously. This means that the control switch and the energy supply switch are actuated essentially at the same time. Hereby an improvement is that a synchronous actuation of these switches may allow a user to be able to permanently recognize if the detachable second control panel is correctly connected to the electric control circuit or not and when the second electric emergency stop switch is operational.

According to a further embodiment, the road building machine is characterized in that if the relay is supplied with electrical energy, the relay is actuated such that both the control switch and the energy supply switch are switched, wherein the control switch and the energy supply switch are preferably integrated in one device, such as a double-switch relay. Coupling the actuation of both the control switch and the energy supply switch via one device allows for a safe control of the emergency stop circuitry because only in the case of the detachable second control panel being supplied with energy the second electric emergency stop switch is in an activated condition such that opening of the second emergency stop switch will open the emergency stop circuitry. Otherwise, an unsafe situation may occur wherein the second emergency stop switch is bridged by a control switch being in a closed condition and thus opening of the emergency stop switch may not effect a shutoff although other functions of the detachable second control panel are operative.

According to a further embodiment, the road building machine is characterized in that the relay is activated by a connection to an activation bridge, said activation bridge preferably being integrated in the detachable control panel. The activation bridge can be integrated in the detachable second control panel or be arranged outside from the detachable control panel. The advantage of such an activation bridge is that the relay can only actuate the switches if the detachable second control panel is connected to the electric control circuit. Therefore, the control switch is only in an open position if the control panel is connected to the electric control circuit.

According to a further embodiment, the road building machine is characterized in that the relay is activated and/or deactivated manually. A manual control of the relay may be possible either in an alternative embodiment or in combination with one of the above described embodiments, allowing for an additional control possibility of the switches if desired.

According to a further embodiment, the road building machine is characterized in that the relay is activated and/or deactivated by a programmable control unit. A control of the relay by a programmable control unit may be possible either in an alternative embodiment or in combination with one of the above described embodiments, allowing for an additional control possibility of the switches if desired.

According to a further embodiment, the road building machine is characterized in that demounting the detachable second control panel from the road building machine and/or electrically disconnecting the second electronic control panel from the electronic control circuit deactivates the relay so that the control switch and the energy supply switch are switched into their normal condition. Hereby an improvement is to allow for reliable functioning of the road building machine, wherein it is important that the control switch cannot be actuated and therefore opened if the detachable second control panel is disconnected and/or demounted.

According to a further embodiment, the road building machine is characterized in that in the event of the detachable second control panel being mounted to the road building machine and/or electrically connecting the detachable second control panel to the electronic control circuit, a connecting interface, which is configured to connect the detachable second control panel to the road building machine, comprises a loop, which effects closing the emergency stop circuitry.

According to a further embodiment, the road building machine is characterized in that the detachable second control panel is located near a screed of the road building machine. An advantage of this location of the detachable second control panel is that it allows the user to control the function of the road building machine via the detachable second control panel and at the same time observe the paving process and the function of the screed.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
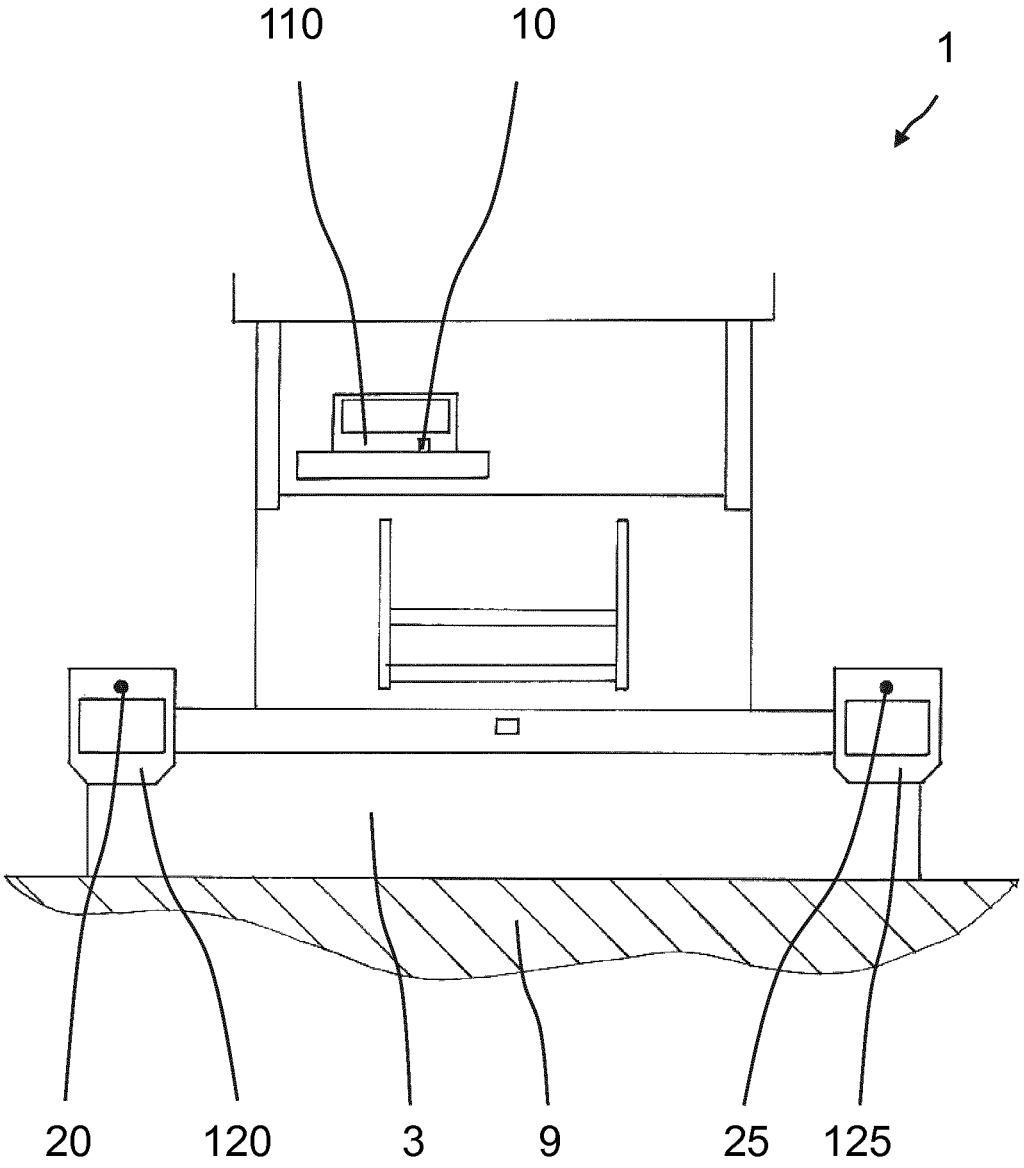
FIG. 1 is a rear view of a paver showing the first control panel in the main control stand and two detachable control panels at the rear sides of the paver.

FIG. 1 shows a rear view of a paver 1 with a first control panel 110 and a first electric emergency stop switch 10 located in the main control stand of the paver. The first control panel 110 is fixed to the paver 1. Two detachable control panels 120, 125 are attached to the screed 3 at the rear side of the paver and located at the left and the right side of the screed 3. The screed 3 is in contact with the paving material 9 and during paving the screed is in a floating condition. The detachable seco7nd control panel 120 comprises a second electric emergency stop switch 20. The detachable third control panel 125 comprises a third electric emergency stop switch 25. Either of the detachable control panels can be demounted and electrically disconnected from the paver.

Figure 2A:
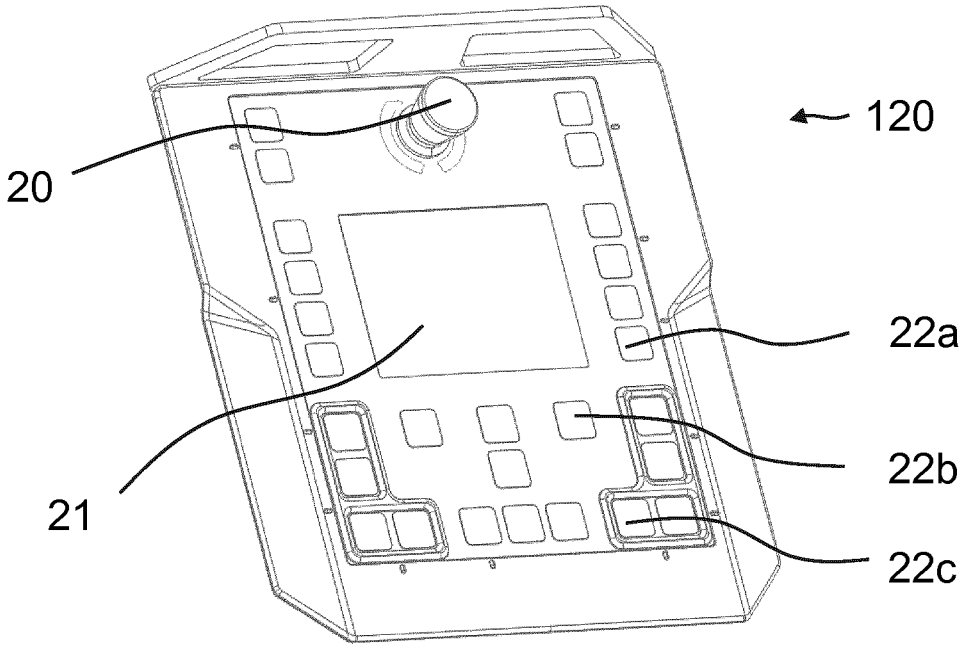
FIG. 2*a* is a schematic front view of a detachable control panel showing the control switches for various actuators, the emergency stop switch.
Figure 2B:
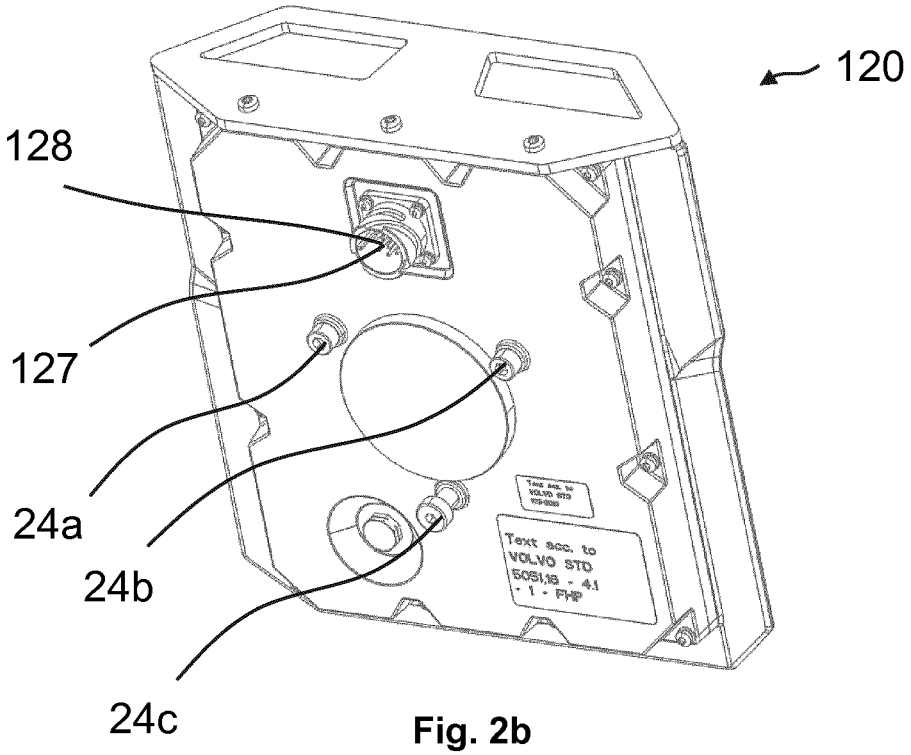
FIG. 2*b* is a schematic back view of a detachable control panel showing the releasable coupling and the releasable electrical connection of the control unit.

FIG. 2*a* schematically shows a detachable control panel 120 comprising an electric emergency stop switch 20, a display 21 for showing parameters concerning the paving process, and several control switches 22*a*, 22*b*, 22*c*, . . . for controlling and changing different parameters of the paving process via controlling various actuators. FIG. 2*b* schematically shows the rear side of a detachable control panel 120 comprising elements for mechanical connection 24*a*, 24*b*, 24*c*, which are configured for attaching the detachable control panel to the paver. Further, an activation bridge 128 is arranged on the rear side of the detachable control panel 120. Said activation bridge serves to activate a relay which may close or open the emergency stop circuitry.

Figure 3:
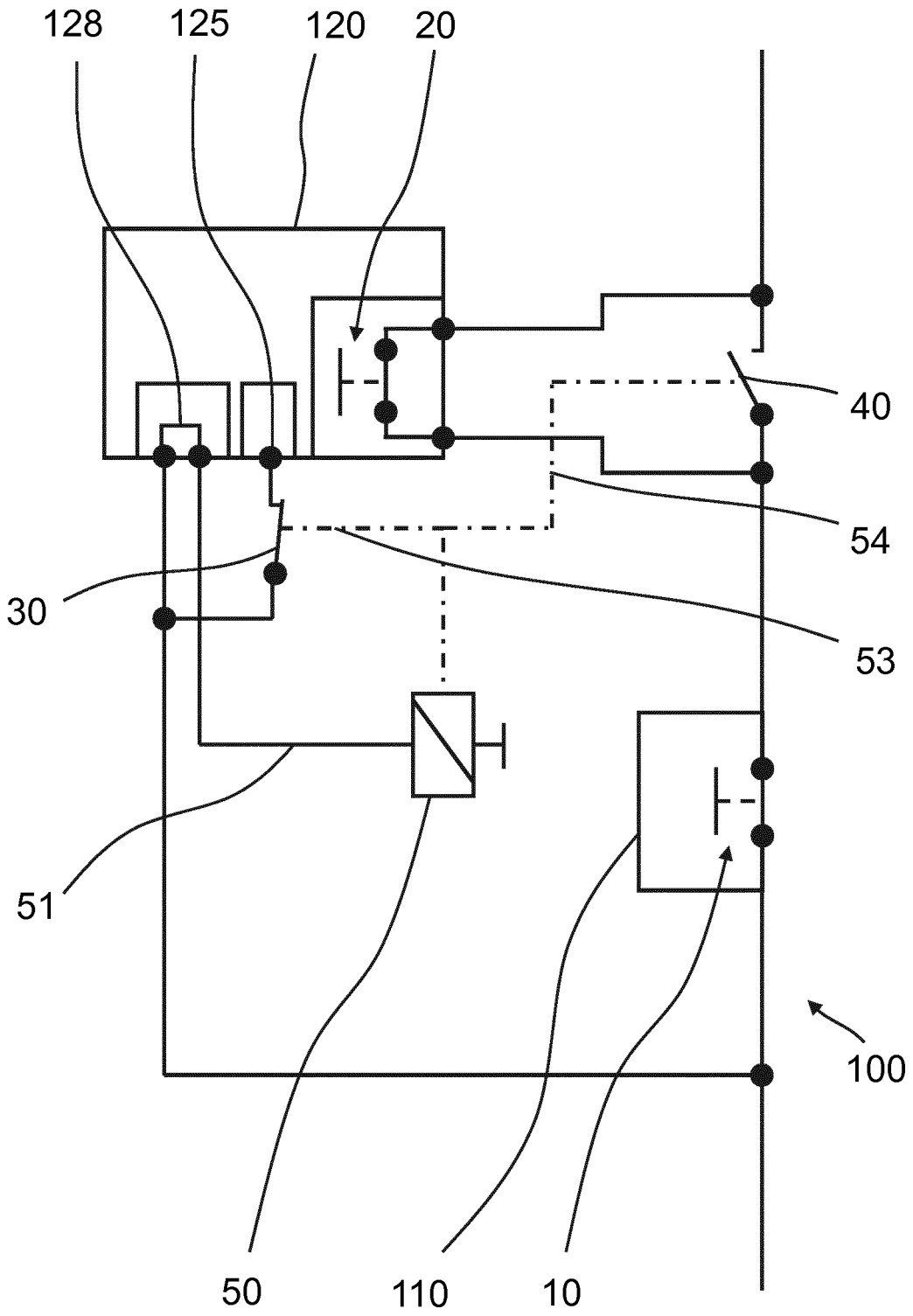
FIG. 3 is a schematic view of an emergency stop circuitry for a paver with connected detachable control panel.

FIG. 3 schematically shows an emergency stop circuitry 100 of a paver and a first control panel 110 with a first electric emergency stop switch 10 connected to said emergency stop circuitry 100. The emergency stop circuitry 100 is part of an electronic control circuit. The electronic control circuit is adapted for controlling a plurality of actuators, namely a first actuator for driving the paver and a second actuator for conveying a building material, such as asphalt, concrete or another paving material. The emergency stop circuitry 100 is adapted to provide an electrical emergency stop signal to the electronic control circuit. The electronic control circuit is adapted to analyze said emergency stop signal and to control the supply of electrical energy to these actuators or to directly control said actuator such that a shutoff of said actuators is effected depending on the status of said emergency stop signal. This is a sort of indirect emergency stop signal transmission.

Furthermore or alternatively the emergency stop circuitry 100 may be configured for directly interrupting specific or all functions of the paver when the emergency stop circuitry 100 is interrupted.

The first electric emergency stop switch 10 can be either closed (i.e. in a first condition) or open (i.e. in a second condition), wherein in the second condition the emergency stop circuitry 100 is interrupted. This is achieved by a user of the first control panel 110 pushing the first emergency stop switch 10. This first control panel 110 comprises a plurality of electronic control switches that are connected to the electronic control circuit.

Furthermore, in FIG. 3 a detachable second control panel 120 is connected to the emergency stop circuitry 100 via a second electric emergency stop switch 20. The second electric emergency stop switch 20 can be either closed (in a first condition) or open (in a second condition), wherein in the second condition the emergency stop circuitry 100 is interrupted. This is achieved by a user of the detachable second control panel 120 pushing the second electric emergency stop switch 20.

The first electric emergency stop switch 10 and the second electric emergency stop switch 20 are connected in series. This means that they are functionally connected to the emergency stop circuitry 100 to effect an opening of the emergency stop circuitry with a logical 'OR' function. Hence, the emergency stop circuitry is interrupted if one of these switches is in the second condition or if both of these switches are in the second condition.

The control switch 40 is connected in parallel to the second electric emergency stop switch 20. This means that they are functionally connected to the emergency stop circuitry 100 to effect an opening of the emergency stop circuitry 100 with a logical 'AND' function and to effect a closing of the emergency stop circuitry 100 with a logical 'OR' function. Hence, the emergency stop circuitry is interrupted if both of these switches are in the open condition and is closed if any of these switches is in the closed condition. Within the condition shown in FIG. 3, the control switch 40 is in an open position because the second electric emergency stop switch 20 is connected to the emergency stop circuitry.

The detachable second control panel 120 further comprises an activation bridge 128 which connects a magnetic coil 50 of a relay to the electronic control circuit via a relay supply circuit 51. The relay has two switches, namely a first load switch 40, which is the control switch connected to the emergency stop circuitry and a second load switch 30, which is an energy supply switch for activating energy supply to the detachable control panel. The first load switch is an NCC and the second load switch is an NOC as shown in FIG. 4 showing the relay condition with no energy supplied to the magnetic coil.

In this setup, the relay 30, 40, 50 is supplied with current to its control terminals (i.e. terminals 85, 86 according to DIN 72552) and both the control switch 40 to be in an open position and the energy supply switch 30 to be in a closed position are activated synchronously as the two switches of the relay in the first condition if the magnetic coil is supplied with energy. The dotted lines in FIG. 3 schematically show the magnetic relation from the coil 50 to the two switches 30, 40 of the relay.

The energy supply switch 30 is electrically connected to the detachable second control panel 120 via a specific connection point 127. The closed position of the energy supply switch 30 allows for the detachable second control panel 120 to be supplied with energy. The open position of the control switch 40 allows for the second electric emergency stop switch 20 to interrupt the emergency stop circuitry 100 if it is pushed by a user.

Figure 4:
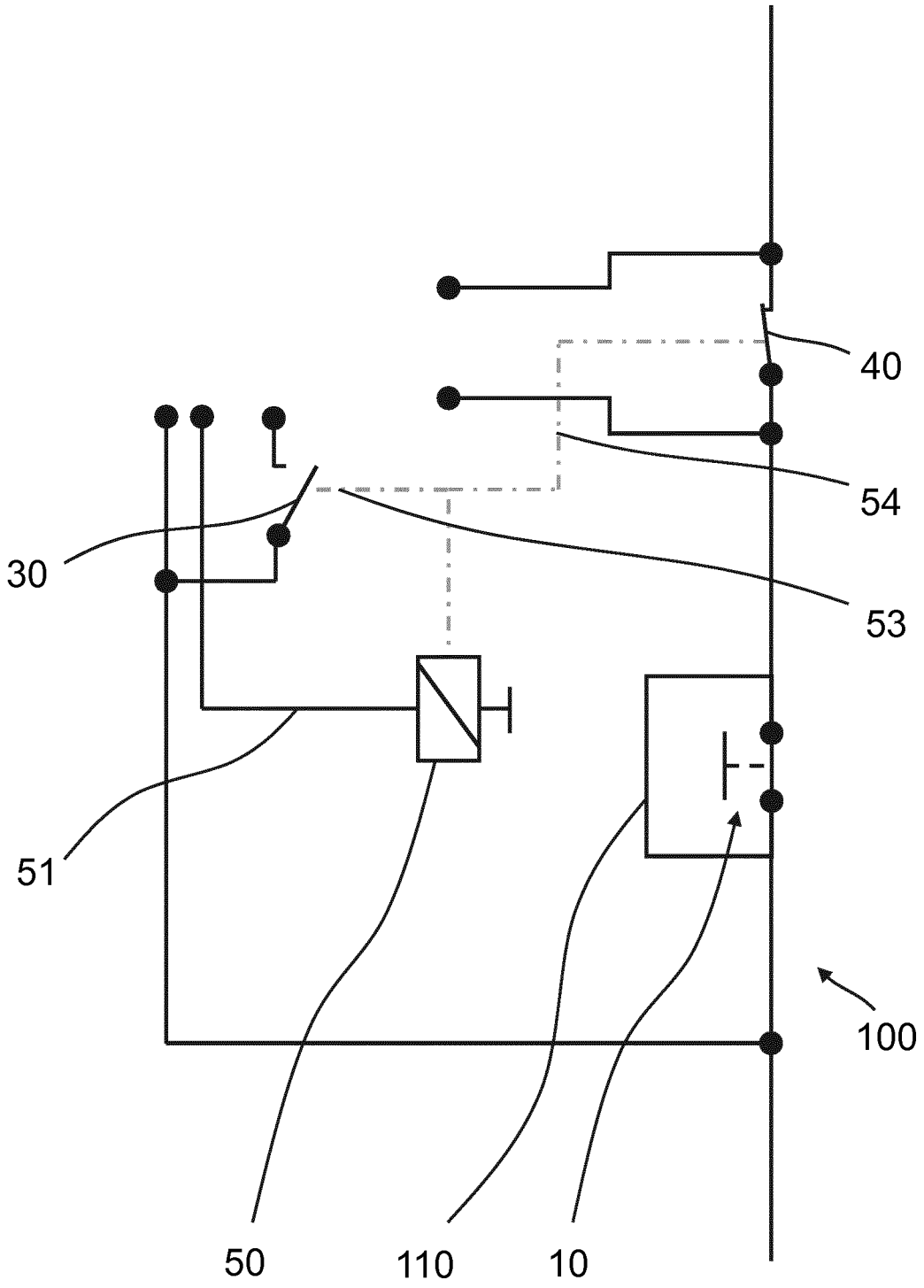
FIG. 4 is a schematic view of an emergency stop circuitry for a paver with disconnected detachable control panel.

FIG. 4 shows the emergency stop circuitry 100 of a paver with the detachable second control panel being electrically disconnected such that the second electric emergency stop switch is electrically disconnected from the emergency stop circuitry 100 like this will occur with the detachable control panel being electrically disconnected.

Now, the magnetic coil 50 of the relay is not supplied with energy because the activation bridge has been removed by removing the detachable control panel. Therefore, the relay is in its non-actuated normal position with the energy supply switch 30 being in an open-condition and the control switch 40 being in a closed position to close the emergency stop circuitry 100. The control switch and the energy supply switch take these positions automatically when the detachable second control panel is electrically disconnected for being removed. In this case, in the section of the emergency stop circuitry 100 shown here, the first control panel 110 with the first electric emergency stop switch 10 is still connected to the emergency stop circuitry 100 and thus only the first electric emergency stop switch 10 may be pushed by a user to interrupt the emergency stop circuitry 100 and to effect a shutoff.

If the detachable second control panel would be electrically connected to the paver again, the condition of FIG. 3 would automatically be set because the relay 50 would be supplied with energy again and an actuation of the control switch into an open position and an actuation of the energy supply switch into a closed position would occur.

It is to be understood that the present invention is not limited to the embodiments described above and illustrated in the drawings; rather, the skilled person will recognize that many changes and modifications may be made within the scope of the appended claims.

The invention claimed is:

1. A road building machine for laying asphalt, comprising an electronic control circuit for controlling at least one actuator for driving said paver and/or handling a building material within said paver, said electronic control circuit comprising an emergency stop circuitry adapted to provide an electrical emergency signal effective for controlling an emergency safe state like a shutoff of at least one of said actuators, wherein said emergency stop circuitry is adapted to supply said emergency signal in a closed circuit condition for driving said actuator(s) and to interrupt said supply of said emergency signal to effect a safe state of at least one of said actuators of the paver in an open circuit condition, a first control panel mounted to the paver and comprising a plurality of electronic control switches electrically connected to said electronic control circuit, said first control panel further comprising a first electric emergency stop switch interconnected in the emergency stop circuitry, wherein in a first condition the first electric emergency stop switch closes the emergency stop circuitry and in a second condition the first electric emergency stop switch opens the emergency stop circuitry, a detachable second control panel detachably coupled for electric signal transmission to the electronic control circuit and preferably being detachably mounted to the paver, said detachable second control panel comprising a second electric emergency stop switch arranged at the detachable second control panel and interconnected in the emergency stop circuitry if the detachable second control panel is electrically connected to the electronic control circuit, wherein in a first condition the second electric emergency stop switch closes the emergency stop circuitry and in a second condition the second electric emergency stop switch opens the emergency stop circuitry, said detachable second control panel preferably further comprising a plurality of second electronic control switches electrically connected to said electronic control circuit, wherein said first electric emergency stop switch and said second electric emergency stop switch are functionally connected to said emergency stop circuitry to effect said opening of said emergency stop circuitry with a logical 'OR' function such that said emergency stop circuitry is open if any or both of the first electric emergency stop switch and the second electric emergency stop switch is in the second condition, the detachable second control panel is adapted to be either mounted to the paver and electrically connected to said electronic control circuit including said emergency stop circuitry or to be demounted from the paver with said detachable second control panel being electrically disconnected from said electronic control circuit and said emergency stop circuitry, wherein said emergency stop circuitry comprises a control switch which is interconnected in the emergency stop circuitry, wherein said control switch is arranged at the paver outside from said detachable second control panel, wherein said control switch is connected in a functional parallel electrical arrangement with the second electric emergency stop switch if the detachable second control panel is electrically connected to the electronic control circuit, wherein said control switch is adapted to be actuated by a switch function preferably activated by said electrical coupling of said detachable second control panel to said electronic control circuit such that if said detachable second control panel is electrically connected to said electronic control circuit, said control switch is actuated into a first condition wherein said control switch is open, such that the emergency stop circuitry is closed or opened via said first or said second electric emergency stop switch, and if said detachable second control panel is electrically disconnected from said electronic control circuit, said control switch is actuated into a second condition wherein said control switch is closed, such that the emergency stop circuitry is closed or opened via said first electric emergency stop switch;

wherein mounting the detachable second control panel to the paver and/or electrically coupling said detachable second control panel to the electronic control circuit actuates both the control switch to switch in the first, open condition, and an energy supply switch to activate an electrical energy supply for the detachable second control panel.

2. The road building machine according to claim 1, wherein if the detachable second control panel is electrically connected to said electronic control circuit, the control switch and the second electric emergency stop switch are functionally connected to the emergency stop circuitry to effect said opening of said emergency stop circuitry with a logical 'AND' function, such that said emergency stop circuitry is open if both of said control switch and the second electric emergency stop switch are in the open condition.

3. The road building machine according to claim 1, wherein the emergency stop circuitry provides an emergency stop signal to an emergency stop control unit adapted to effect said emergency safe state depending on said emergency signal, wherein said emergency signal preferably is a binary ON/OFF-signal depending from the emergency stop circuitry being open or closed.

4. The road building machine according to claim 1, wherein the second control panel is mechanically detachably mounted to the paver and electrically detachably connected for electric signal transmission to the electronic control circuit, or a remote control panel detachably connected for electric signal transmission to the electronic control circuit including said emergency stop circuitry via wireless signal transmission.

5. The road building machine according to claim 1, wherein if the detachable second control panel is electrically connected to said electronic control circuit, the control switch is adapted to automatically switch in the first, open condition, and if the detachable second control panel is electrically disconnected from said electronic control circuit, the control switch is adapted to automatically switch in the second, closed condition to close said emergency stop circuitry.

6. The road building machine according to claim 1, wherein the electronic control circuit is provided with electrical energy in an open circuit condition of the emergency stop circuitry.

7. The road building machine according to claim 1, wherein the control switch and the energy supply switch are actuated synchronously.

8. The road building machine according to claim 1, wherein the detachable second control panel is located near a screed of the paver.

9. The road building machine according to claim 1, wherein if the detachable second control panel is electrically connected to said electronic control circuit, a relay supply circuit is closed to supply a magnetic coil of a relay with electric current, wherein said relay actuates the control switch to automatically switch in the first, open condition, and if the detachable second control panel is electrically disconnected from said electronic control circuit, the relay supply circuit is open so that said magnetic coil of said relay is not supplied with electric current and the control switch is adapted to automatically switch in the second, closed condition.

10. The road building machine according to claim 9, wherein if the relay is supplied with electrical energy, the relay effects switching of both the control switch and the energy supply switch, wherein the control switch and the energy supply switch are preferably integrated in one device.

11. The road building machine according to claim 9, wherein the magnetic coil of the relay is activated by a connection to an activation bridge, said activation bridge preferably being integrated in the detachable second control panel.

12. The road building machine according to claim 9, wherein the relay is activated and/or deactivated manually or the relay is activated and/or deactivated by a programmable control unit.

13. The road building machine according to claim 9, wherein electrically disconnecting the detachable second control panel from the paver and/or electrically disconnecting the second emergency stop switch from the electronic control circuit deactivates the relay so that the control switch is switched in the closed condition and the energy supply is switch in the open condition.

* * * * *